US007615974B1

(12) United States Patent
Xu

(10) Patent No.: US 7,615,974 B1
(45) Date of Patent: Nov. 10, 2009

(54) HIGH DIMMING RATIO LED DRIVE CIRCUIT

(75) Inventor: Xiaoru Xu, Hangzhou (CN)

(73) Assignee: National Semiconductor Corporation, Santa Clara, CA (US)

( * ) Notice: Subject to any disclaimer, the term of this patent is extended or adjusted under 35 U.S.C. 154(b) by 179 days.

(21) Appl. No.: 11/937,104

(22) Filed: Nov. 8, 2007

(51) Int. Cl.
*G05F 1/575* (2006.01)
*G05F 1/59* (2006.01)

(52) U.S. Cl. ..... 323/271; 323/225; 323/285

(58) Field of Classification Search ..... 323/222, 323/223, 225, 268, 271, 282, 284, 285, 350, 323/351

See application file for complete search history.

(56) References Cited

U.S. PATENT DOCUMENTS 6,844,760 B2 1/2005 Koharagi et al.
7,071,630 B1 7/2006 York
7,115,888 B2 10/2006 Hachiya et al.
7,119,498 B2 10/2006 Baldwin et al.
7,183,723 B2 2/2007 Yu et al.
7,199,560 B2 * 4/2007 Cheung et al. ..... 323/222
7,495,423 B1 * 2/2009 Knight et al. ..... 323/284

OTHER PUBLICATIONS

Chen, C.C. et al., LED Back-Light Driving System for LCD Panels, Applied Power Electronics Conference and Exposition, APEC 2006, Twenty-First Annual IEEE, Mar. 2006, pp. 381-385.
Prathyusha, Narra et al., An Effective LED Dimming Approach, Industry Applications Conference, 39th IAS Annual Meeting, Conference Record of the 2004 IEEE, vol. 3, Oct. 2004, pp. 1671-1676.
Doshi, Montu, et al., Digital Architecture for Driving Large LED Arrays with Dynamic Bus Voltage Regulation and Phase Shifted PWM, Applied Power Electronics Conference, APEC, Twenty-Second Annual IEEE, Feb. 2007, pp. 287-293.

* cited by examiner

*Primary Examiner*—Gary L Laxton
(74) *Attorney, Agent, or Firm*—Darby & Darby P.C.; Matthew M. Gaffney

(57) ABSTRACT

The invention relates to a method and an apparatus for controlling average current by pulse modulating an output current. The apparatus includes a constant-on-time switching regulator. During the pulse modulation on-time, an output voltage is regulated at a level corresponding to a defined value of a corresponding output current. A control signal is provided to indicate an adjustment to the output voltage that enables regulation of the output current to the defined value. During the pulse modulation off-time, the output voltage is maintained at the level that substantially corresponds to the defined value of the output current during the pulse-modulation on-time.

20 Claims, 4 Drawing Sheets

HIGH DIMMING RATIO LED DRIVE CIRCUIT

TECHNICAL FIELD

The invention is generally directed to the area of current control. The invention is directed, particularly, but not exclusively to a method and an apparatus for controlling average current.

BACKGROUND

Certain electronic devices and circuits employ current regulators to provide a relatively constant average current. For example, certain illumination devices provide illumination at an intensity related to the average current through the device. By selectively regulating the average current to different values at different times, an illumination device may be used to provide illumination at selectable intensity levels.

The average current may be changed by controlling the instantaneous current to the load. In certain illumination devices, the emitted color spectrum may be related to the instantaneous current through the device. For example, many light emitting diodes (LEDs) provide light at different wavelengths when driven at differing levels of instantaneous current. In this example, independent control of the average current and the instantaneous current allows for independent control of the emitted color spectrum and the intensity of the illumination.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified. These drawings are not necessarily drawn to scale.

For a better understanding of the present invention, reference will be made to the following Detailed Description, which is to be read in association with the accompanying drawings, wherein.

DETAILED DESCRIPTION

Figure 1:
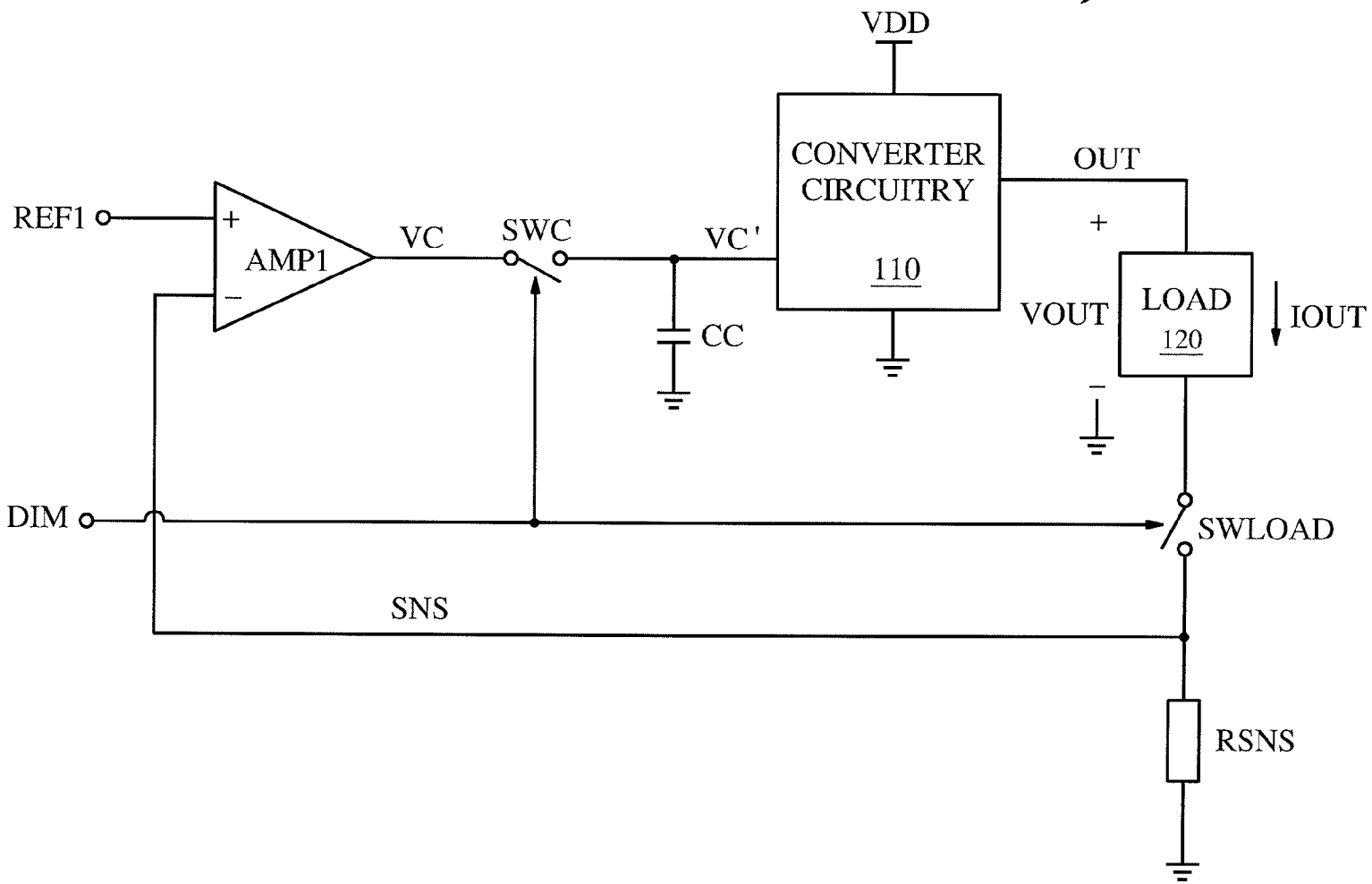
FIG. 1 is a block diagram of an embodiment of a regulation system according to aspects of the present invention.

Various embodiments of the present invention will be described in detail with reference to the drawings. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" includes plural reference. References in the singular are made merely for clarity of reading and include plural reference unless plural reference is specifically excluded. The meaning of either "in" or "on" includes both "in" and "on." The term "or" is an inclusive "or" operator, and is equivalent to the term "and/or" unless specifically indicated otherwise. The term "based on" or "based upon" is not exclusive and is equivalent to the term "based, at least in part, on" and includes being based on additional factors, some of which are not described herein. The term "coupled" means at least either a direct electrical connection between the items connected, or an indirect connection through one or more passive or active intermediary devices. The term "circuit" means at least either a single component or a multiplicity of components, either active and/or passive, that are coupled together to provide a desired function or functions. The term "signal" means at least one current, voltage, charge, temperature, data, or other signal. A "signal" may be used to communicate using active high, active low, time multiplexed, synchronous, asynchronous, differential, single-ended, or any other digital or analog signaling or modulation techniques. A "signal" may also be employed to provide and/or transmit power. Where either a field effect transistor (FET) or a bipolar transistor may be employed as an embodiment of a transistor, the scope of the words "gate", "drain", and "source" includes "base", "collector", and "emitter", respectively, and vice versa. The phrase "in one embodiment," as used herein does not necessarily refer to the same embodiment, although it may.

Briefly stated, the invention relates to a method and an apparatus for controlling average current by pulse modulating an output current. The apparatus includes a constant-on-time switching regulator. During the pulse modulation on-time, an output voltage is regulated at a level corresponding to a defined value of a corresponding output current. A control signal is provided to indicate an adjustment to the output voltage that enables regulation of the output current to the defined value. During the pulse modulation off-time, the output voltage is maintained at the level that substantially corresponds to the defined value of the output current during the pulse-modulation on-time.

FIG. 1 is a block diagram of an embodiment of regulation system 100. Regulation system 100 includes converter circuitry 110, load 120, load switch SWLOAD, sense resistor RSNS, amplifier AMP1, control signal switch SWC, capacitor CC. Regulation system 100 is arranged to pulse modulate and regulate output current IOUT.

Regulation system 100 is arranged drive load 120 with low duty cycle/high dimming ratio output current IOUT. In one such embodiment, regulation system 100 is arranged to buffer control signal VC' such that converter circuitry 110 is enabled to quickly resume regulation of output signal OUT upon the closing of switch SWLOAD.

Converter circuitry 110 is arranged to provide substantially constant output current IOUT on output signal OUT based, at least in part, upon a reference signal (not shown in FIG. 1) and control signal VC'. In one embodiment, output current IOUT is supplied to load 120 while load switch SWLOAD is closed. While load switch SWLOAD is open, substantially no current is provided to load 120. Converter circuitry 110 may provide output current IOUT of any magnitude that is suitable for a particular application. For example, the magnitude of output current IOUT is based, at least in part, on a nominal value or an average value for output current IOUT. In one embodiment, a switching current regulator is employed as converter circuitry 110. Converter circuitry 110 is discussed in further detail in reference to FIG. 2 and FIG. 4, for certain embodiments.

Amplifier AMP1 is arranged to receive reference signal REF1, to receive current sense signal SNS, and to provide amplifier output signal VC. In one embodiment, amplifier AMP1 is an error amplifier circuit that is arranged to provide amplifier output signal VC based, at least in part, on the difference between reference signal REF1 and current sense signal SNS. Likewise, in one embodiment, amplifier circuit AMP1 may be a transconductance amplifier. In addition, amplifier AMP1 may include compensation circuitry, and/or the like.

Reference signal REF1 is a substantially constant signal that may be provided by either an internal or external reference source. In one embodiment, reference signal REF1 may be a reference voltage that is provided by a band-gap reference circuit. In another embodiment, reference signal REF1 may be a reference current that is provided by a current mirror. In other embodiments, circuits such as linear regulators, Zener diodes, digital-to-analog converters, voltage controlled current sources, current amplifiers, current regulators, and/or the like, may be suitably employed to provide reference signal REF1.

Control signal switch SWC is arranged to selectively couple the output of amplifier AMP1 to capacitor CC based on dimming signal DIM. In one embodiment, control signal switch SWC includes an N-channel MOSFET device. However, in other embodiments, control signal switch SWC may include a P-channel MOSFET device, a BJT transistor, a JFET transistor, and/or the like, instead of an N-channel MOSFET device.

Sense resistor RSNS is arranged to provide current sense signal SNS based, at least in part, on the magnitude of output current IOUT. Sense resistor RSNS may be of any suitable type or value.

Capacitor CC is arranged as a signal buffer to maintain the voltage of signal VC' while control signal switch SWC is open. Capacitor CC may be of any suitable type or value. In other embodiments, other buffers, storage circuits, and/or the like may be employed.

In one embodiment, load 120 is an LED, a string of LEDs, array of LEDs, electroluminescent device, other illumination device, and/or the like. In one embodiment, regulation system 100 may be employed to control the current through load 120 such that it can provide illumination at multiple intensity levels. For example, if employed with a photography system, these intensity levels may include an "off" level, a "preview" level, a "flash" level, and/or the like. If employed with a television display, computer monitor, mobile device display, and/or the like, these intensity levels may provide multiple display intensity settings to optimize between brightness and power consumption. In addition, embodiments of the invention may be employed to provide high dimming ratio backlight control for display devices employing dynamic contrast ratio backlighting. For example, devices employing dynamic contrast ratio backlighting include liquid crystal displays, plasma displays, and/or the like.

Regulation system 100 may also be employed to provide current to a non-illumination device load. Such load may be any electrical load through which electrical current flows. For example, regulation system 100 may supply current to an electronic device or circuit such as a computer, television, mobile device, wireless device, motor, and/or the like. These and other applications are within the spirit and scope of the invention.

Load switch SWLOAD is arranged to selectively enable/disable a current path through load 120 based on dimming signal DIM. In one embodiment, load switch SWLOAD includes an N-channel MOSFET device. However, in other embodiments, load switch SWLOAD may include a P-channel MOSFET device, a BJT transistor, a JFET transistor, and/or the like, instead of an N-channel MOSFET device.

In one embodiment, regulation system 100 is arranged to pulse modulated output current IOUT by controlling the opening and closing of switch SWLOAD under the control of dimming signal DIM. In one such embodiment, regulation system 100 provides control signal VC' to converter circuitry 110 such that while load switch SWLOAD and control signal switch SWC are closed, converter circuitry 110 maintains voltage VOUT to a level corresponding to a regulated value of output current IOUT. The regulated value of output current IOUT is defined, for example, by reference signal REF1. During the time that load switch SWLOAD and control signal switch SWC are closed, control signal VC' is provided to indicate the adjustment and/or offset to voltage VOUT that enables regulation of output current IOUT.

When load switch SWLOAD and control signal switch SWC are open, converter circuitry 110 continues to regulate voltage VOUT to the level that substantially corresponds to the value of output current IOUT during the time prior to the opening of switch SWLOAD. In one embodiment this hybrid voltage/current regulation of output signal OUT enables decreased converter circuitry 110 start-up time upon the close of load switch SWLOAD. In addition, this enables output current IOUT to be provided more quickly after the close of load switch SWLOAD. Likewise, the minimum sustainable duty cycle and/or pulse width of dimming signal DIM is decreased. In one embodiment, the decrease in the minimum sustainable pulse width enables high dimming ratio drive of load 120.

In at least one embodiment, regulation system 100 differs from the illustrated embodiment. For example, a pulse modulation circuit may be provided to drive dimming signal DIM, a current sense amplifier may be employed to provide current sense signal SNS, and/or the like. In addition, regulation system 100 may be coupled between a positive input power supply and a negative input power supply, between ground and a negative power supply, between two positive power supplies, and/or the like.

Figure 2:
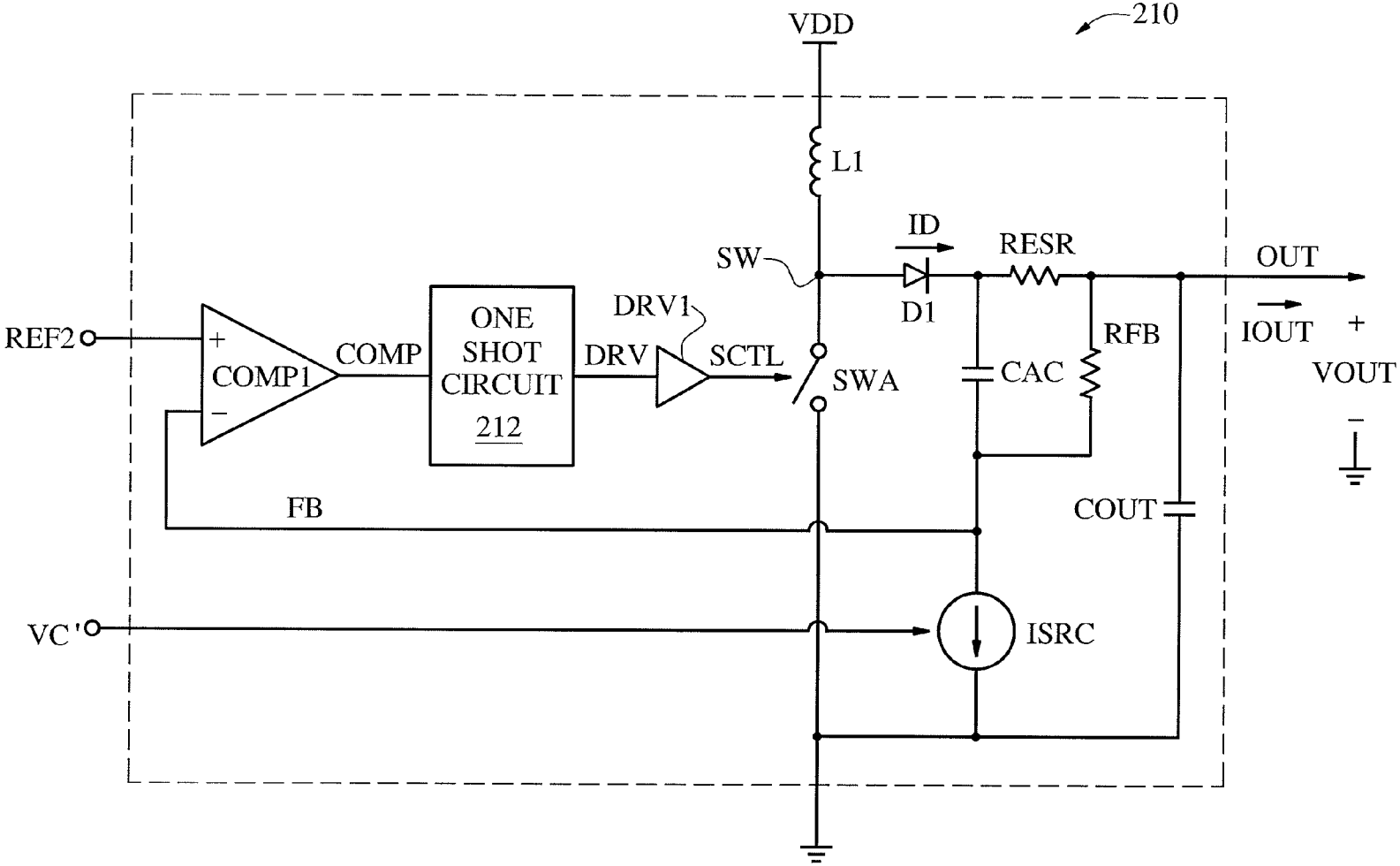
FIG. 2 is a schematic diagram of an embodiment of the converter circuitry of FIG. 1 according to aspects of the present invention.
Figures 3A, 3B, 3C, 3D:
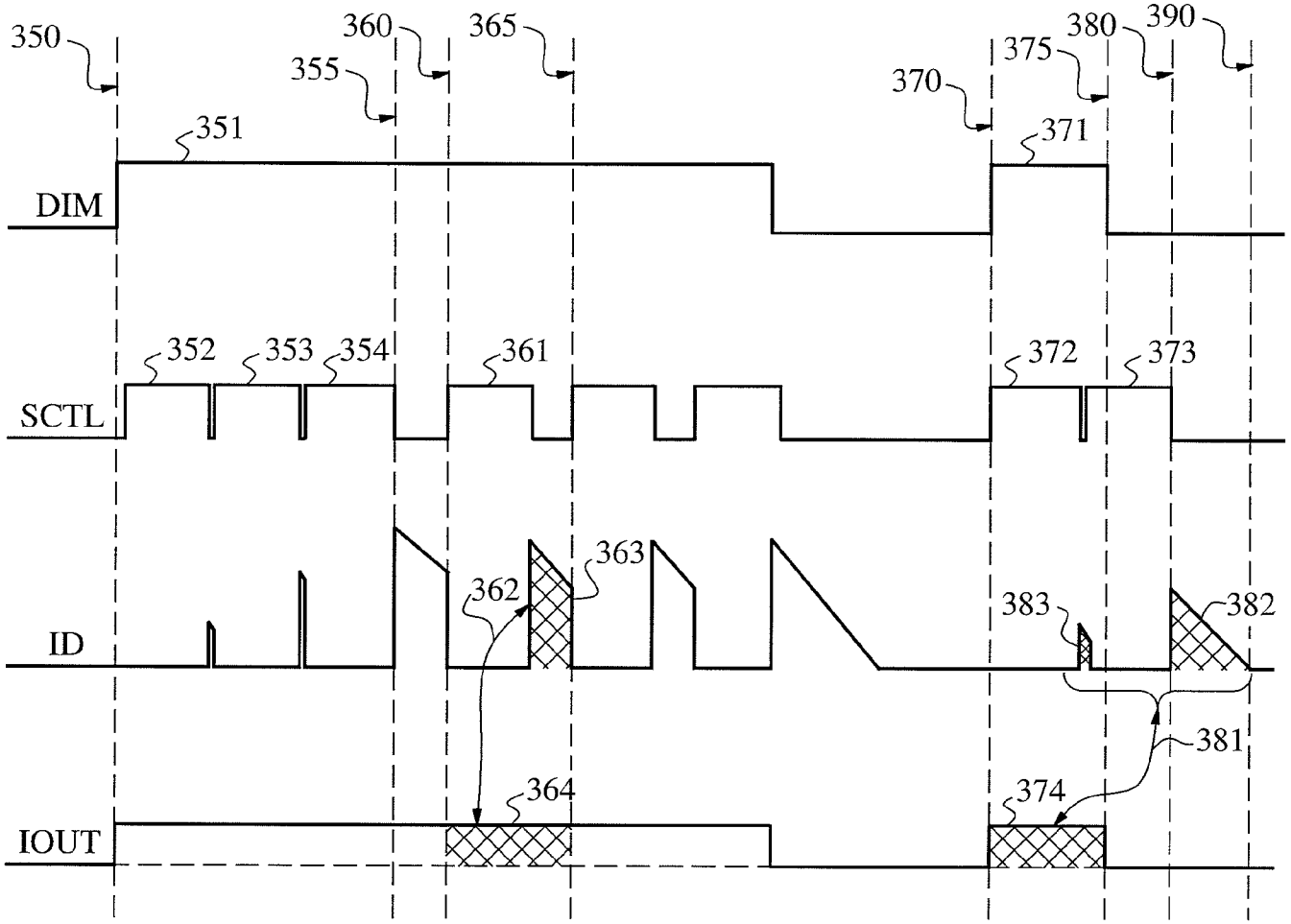
FIGS. 3A-3D are timing diagrams illustrating waveforms of embodiments of signals for an embodiment of the regulation system of FIG. 1 and FIG. 2.

FIG. 2 is a schematic diagram of an embodiment of converter circuitry 210. Converter circuitry 210 includes comparator COMP1, one shot circuit 212, driver DRV1, inductor L1, switch SWA, diode D1, capacitor CAC, resistor RESR, feedback resistor RFB, current source ISRC, and output capacitor COUT. Converter circuitry 210 may be employed as an embodiment of converter circuitry 110 of FIG. 1.

Converter circuitry 210 is arranged to receive input power signal VDD and control signal VC'. Converter circuitry 210 is further arranged to provide regulated power signal OUT from input power signal VDD based, at least in part, on input power signal VDD, control signal VC', and reference signal REF2. In the illustrated embodiment, converter circuitry 210 is arranged as a constant-on-time switching boost regulator.

Comparator COMP1 is arranged to provide comparison signal COMP based, at least in part, on a difference between reference signal REF2 and feedback signal FB. In one embodiment, comparison signal COMP is driven high while reference signal REF2 is greater than feedback signal FB. Likewise, comparison signal COMP is driven low while reference signal REF2 is less than feedback signal FB.

In one embodiment, one shot circuit 212 is arranged to provide driver input signal DRV to driver DRV1 based, at least in part, on comparison signal COMP. In one embodiment, one shot circuit 212 is arranged such that it provides a configured duration output pulse when comparison signal COMP transitions. For example, one shot circuit 212 may be configured to provide an output pulse either following any edge, a rising edge, falling edge, and/or the like on comparison signal COMP. The duration of the output pulse may be determined by any suitable means. In at least one embodiment, the duration of the output pulse is inversely proportional to the magnitude of an input voltage. In other embodiments, it is determined by the value of a configuration resistor, a potentiometer setting, a digital to analog converter output, a timer output, a clock signal, a register setting, and/or the like (not shown).

In one embodiment, driver circuit DRV1 is arranged to drive switch SWA based on driver input signal DRV. Driver DRV1 may be any driver type that is suitable to drive the control input of a switch circuit of a converter. In other embodiments, driver DRV1 may be omitted.

Switch SWA is arranged to selectively couple input power signal VDD to switch node SW and to provide output signal OUT based on switch control signal SCTL. In one embodiment, switch SWA includes an N-channel MOSFET device. However, in other embodiments, switch SWA may include a P-channel MOSFET device, a BJT transistor, a JFET transistor, and/or the like, instead of an N-channel MOSFET device.

Diode D1 is arranged to rectify the power at node SW to provide output signal OUT. In other embodiments, converter circuitry 210 may be synchronously rectified.

In one embodiment, resistor RESR is provided to increase the effective equivalent series resistance (ESR) associated with output signal OUT. For example, resistor RESR may be provided to effectively increase the ESR of a low ESR output capacitor such as certain embodiments of capacitor COUT. In other embodiments, resistor RESR may be omitted.

In one embodiment, capacitor CAC is arranged to couple the ripple at the output of diode D1, to the inverting input of comparator COMP1. For example, this ripple may be the combination of the ripple on resistor RESR and the ripple on output capacitor COUT. In other embodiments, capacitor CAC may be omitted.

Resistor RFB is arranged to receive output signal OUT and to provide feedback signal FB to comparator COMP1. In one embodiment, feedback resistor RFB is arranged to provide feedback signal FB in cooperation with current source ISRC. Feedback signal FB is based, in part, on the voltage of output signal OUT.

In one embodiment, current source ISRC is arranged as a feedback adjustment circuit that includes a voltage controlled current source which adjusts the value of feedback signal FB based, at least in part, on control signal VC'. In one embodiment, resistor RFB and current source ISRC are arranged to enable hybrid voltage/current regulation of output signal OUT, as discussed above. This hybrid voltage/current regulation also reduces the time needed to restore current flow into or out of inductor L1, for example, following the assertion of dimming signal DIM of FIG. 1.

In other embodiments, other circuits may be employed instead of, or in conjunction with, resistor RFB and/or current source ISRC. For example, an offset amplifier, a summing amplifier, a difference amplifier, and/or the like may be employed to provide feedback signal FB based, at least in part, on output signal OUT and on control signal VC'. Likewise, control signal VC' may be employed to directly offset and/or adjust the switching point of comparator COMP1. These and other variations are within the spirit and scope of the invention.

Inductor L1 and capacitor COUT may be of any suitable types or values for use with power regulation. In one embodiment, capacitor COUT is a ceramic capacitor with a relatively low ESR.

FIGS. 3A-3D are timing diagrams illustrating waveforms of embodiments of signals for an embodiment of the regulation system of FIG. 1 and FIG. 2. FIGS. 3A-3D illustrate waveforms of dimming signal DIM, switch control signal SCTL, diode D1 current ID, and output current IOUT, respectively. Other embodiments of regulation systems may operate differently without departing from the spirit and scope of the invention. FIGS. 3A-3D are not necessarily drawn to scale.

At time 350, a relatively long duration PWM pulse 351 begins. At the beginning of PWM pulse 351, one shot circuit 212 provides constant-on-time pulse 352 to switch control signal SCTL. Following the end of constant-on-time pulse 352, the available energy in inductor L1 is relatively insufficient to efficiently transfer energy to output capacitor COUT. Accordingly, one shot circuit 212 additionally provides additional constant-on-time pulse 353 following a short off-time. Likewise, one shot circuit 212 also additionally provides constant-on-time pulse 354 following another short off-time.

During the start-up period between time 350 and time 355, relatively little energy is transferred through inductor L1. Accordingly, the energy supplied to load 120 is provided from output capacitor COUT. After constant-on-time pulse 354, at time 355, relatively sufficient energy has been stored in inductor L1 to efficiently provide energy to output capacitor COUT. This energy is transferred via rectification current ID through diode D1.

At time 360, one shot circuit 212 provides constant-on-time pulse 361. Following the end of constant-on-time pulse 361, energy is transferred to output capacitor COUT through diode D1. In one embodiment, the energy provided to load 120 via output current IOUT and the energy transferred through diode D1 are substantially equivalent for the period between times 360 and 365. In one embodiment, this charge balance is illustrated by arrow 362 between area 363 and area 364. In this manner, regulation system 100 can continue regulation of output current IOUT for the duration of PWM pulse 351.

At time 370, a relatively short duration PWM pulse 371 begins. At the beginning of PWM pulse 371, one shot circuit 212 provides constant-on-time pulse 372. Following the end of constant-on-time pulse 372, the available energy in inductor L1 is relatively insufficient to efficiently transfer energy to output capacitor COUT. Accordingly, one shot circuit 212 additionally provides constant-on-time pulse 373 following a short off-time.

At time 375, PWM pulse 371 ends. Due to the relatively short length of PWM pulse 371, regulation system 100 provides insufficient constant-on-time pulses to reach the end of the start-up period. However, at time 380, constant-on-time pulse 373 ends and the energy that was provided to inductor L1 during constant-on-time pulses 372 and 373 is transferred to capacitor COUT. As illustrated by arrow 381 between area 374 and both area 382 and area 383, the charge balance of capacitor COUT is restored after the end of PWM pulse 371. In this manner, regulation system 100 is also enabled to regulate output current IOUT for PWM pulses that are too short for regulation system 100 to complete a start-up period.

As discussed above, in one embodiment, regulation system 100 enables relatively low duty cycle operation, high dimming ratio drive, and/or the like.

Figure 4:
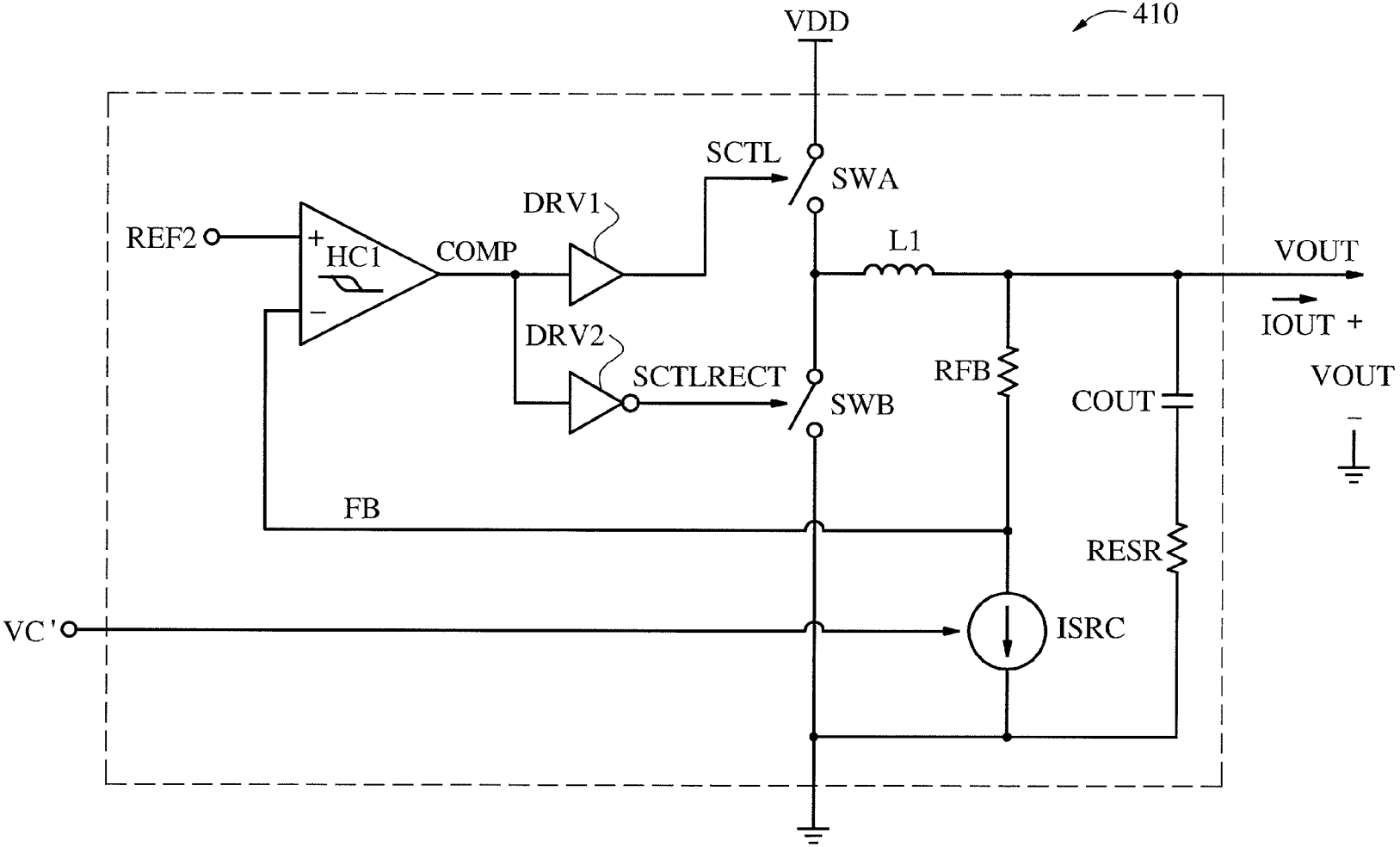
FIG. 4 is a schematic diagram of another embodiment of the converter circuitry of FIG. 1 according to aspects of the present invention.

FIG. 4 is a schematic diagram of an embodiment of converter circuitry 410. Converter circuitry 410 includes hysteretic comparator HC1, driver DRV1, inverting driver DRV2, switch SWA, switch SWB, inductor L1, feedback resistor RFB, current source ISRC, output capacitor COUT, and resistor RESR. Converter circuitry 410 may be employed as an embodiment of converter circuitry 110 of FIG. 1.

In yet other converter circuitry embodiments, the converter circuitry may differ from the described embodiments. For example, other converter circuitry may include protection circuits such as under-voltage protection circuits, over-voltage protection circuits, over-current protection circuits, under-current protection circuits, temperature protection circuits, battery status monitoring circuits, and/or the like. Likewise, other embodiments of converter circuitry may include any converter circuitry that is suitable to provide power to the load. For example, suitable converter circuitry may include pulse frequency modulated (PFM) switching regulation converter circuitry, conversion circuitry with fast output current transient response, and/or the like. These and other variations are within the spirit and scope of the invention.

The above specification, examples and data provide a description of the method and applications, and use of the invention. Since many embodiments of the invention can be made without departing from the spirit and scope of the invention, this specification merely set forth some of the many possible embodiments for the invention.

What is claimed as new and desired to be protected by Letters Patent of the United States is:

1. A circuit for regulating power, comprising:

an amplifier circuit that is arranged to receive a current sense signal, to receive a first reference signal, and to provide an amplifier output signal at an amplifier node, such that the amplifier output signal is based, at least in part, on the current sense signal and the first reference signal;

a control signal switch that is coupled between the amplifier node and a control node and that is arranged to be closed during a first time period and to be open during a second time period; and converter circuitry that is arranged to receive a control signal at the control node and to control the regulation of an output signal, wherein the converter circuitry includes:

a comparison circuit that is arranged to compare a second reference signal and a feedback signal, wherein the feedback signal is based, in part, on the output signal;

a feedback circuit that is arranged to provide the feedback signal based, at least in part, on the output signal; and a feedback adjustment circuit that is arranged to adjust the feedback signal based, at least in part, on the control signal.

2. The circuit of claim 1, wherein the feedback adjustment circuit includes:

a voltage controlled current source that is arranged to receive the control signal and to provide a feedback adjustment current that is based, at least in part, on the control signal.

3. The circuit of claim 1, wherein the converter circuitry includes a one shot circuit that is arranged to receive a comparison signal and to provide a switch control signal, and is arranged such that if the comparison signal is asserted, the switch control signal is asserted for a configured duration and is de-asserted at the end of the configured duration.

4. The circuit of claim 1, wherein the converter circuitry includes pulse frequency modulation regulation circuitry.

5. The circuit of claim 1, wherein the converter circuitry includes:

an inductor that is coupled between an input power node and a switch node;

a switch circuit that is arranged to selectively couple the switch node to a supply return node; and a rectification circuit that is arranged to rectify an output of the inductor, and wherein the converter circuitry is arranged as a boost-mode switching regulator.

6. The circuit of claim 1, wherein the converter circuitry is arranged to, during the first time period, receive the control signal and to regulate a current of the output signal to a defined current value based, at least in part, on the control signal and on the second reference signal; and is further arranged to, during the second time period, regulate a voltage of the output signal to a first voltage value based, at least in part, on the control signal and on the second reference signal, wherein the first voltage value is substantially equal to the voltage of the output signal during a portion of the first time period.

7. The circuit of claim 1, wherein the control signal switch is arranged such that the control signal is substantially equal to the amplifier output signal while the control signal switch is closed, and is arranged such that a voltage of the control signal is enabled to be held while the control signal switch is open.

8. The circuit of claim 7, further comprising a capacitor that is arranged to, while the control signal switch is open, hold the voltage of the control signal.

9. A circuit for regulating power, comprising:

an amplifier circuit that is arranged to receive a current sense signal, to receive a first reference signal, and to provide an amplifier output signal at an amplifier node, such that the amplifier output signal is based, at least in part, on the current sense signal and the first reference signal;

a control signal switch that is coupled between the amplifier node and a control node and that is arranged to be closed during a first time period and to be open during a second time period; and converter circuitry that is arranged to, during the first time period, receive a control signal at the control node and to regulate a current of an output signal at an output node to a defined current value based, at least in part, on the control signal and on a second reference signal; and is further arranged to, during the second time period, regulate a voltage of the output signal to a first voltage value based, at least in part, on the control signal and on the second reference signal, wherein the first voltage value is substantially equal to the voltage of the output signal during a portion of the first time period.

10. The circuit of claim 9, wherein the first time period corresponds to a pulse width modulation on-time, and wherein the second time period corresponds to a pulse width modulation off-time, wherein the converter circuitry is arranged such that the current of the output signal is substantially equal to zero during the pulse width modulation off-time.

11. The circuit of claim 9, wherein the converter circuitry is further arranged to receive a control signal at the control node and to control the regulation of the output signal, and wherein the converter circuitry includes:

a comparison circuit that is arranged to compare the second reference signal and a feedback signal, wherein the feedback signal is based, in part, on the output signal;

a feedback circuit that is arranged to provide the feedback signal based, at least in part, on the output signal; and a feedback adjustment circuit that is arranged to adjust the feedback signal based, at least in part, on the control signal.

12. The circuit of claim 9, wherein the control signal switch is arranged such that the control signal is substantially equal to the amplifier output signal while the control signal switch is closed, and is arranged such that a voltage associated with the control signal is enabled to be held while the control signal switch is open.

13. The circuit of claim 9, further comprising:

an illumination device load, wherein the illumination device load includes at least one of a light emitting diode string or an electroluminescent circuit.

14. The circuit of claim 9, wherein the amplifier circuit includes a transconductance amplifier.

15. The circuit of claim 9, further comprising a load current path switch that is arranged to be coupled in series with a load, and that is arranged to, while closed, enable a current path through the load and to, while open, disable a current path through the load.

16. The circuit of claim 15, further comprising:

a pulse modulation circuit that is arranged to provide and pulse modulate a dimming signal, wherein the control signal switch is arranged to be closed while the dimming signal is asserted and to be open while the dimming signal is deasserted, and wherein the load current path switch is arranged to be closed when the dimming signal is asserted and to be open when the dimming signal is deasserted.

17. The circuit of claim 9, wherein the converter circuitry includes:

a feedback resistor that is coupled between the output node and a feedback node; and a voltage controlled current source that is arranged to receive the control signal and to provide a feedback adjustment current to the feedback node based, at least in part, on the control signal.

18. The circuit of claim 17, further comprising:

a sense resistor that is arranged to provide the current sense signal based, at least in part, on a current through a load, wherein the sense resistor is separate from the feedback resistor.

19. A method for regulating power, comprising:

pulse modulating an output signal, including:

during a pulse modulation on-time period:

regulating a voltage associated with the output signal to a voltage level that substantially corresponds to a defined value of a current associated with the output signal;

storing the voltage level; and providing the current associated with the output signal to a load; and during a pulse modulation off-time period;

regulating the voltage of the output signal to the stored voltage level; and providing substantially no current to the load.

20. The method of claim 19, whereby the regulating the voltage of the output signal to the stored voltage level during the pulse modulation off-time period enables a charge balance to be substantially maintained while a duration of the pulse modulation on-time is relatively reduced.

* * * * *